United States Patent [19]

Odenwälder et al.

[11] Patent Number: 4,897,341

[45] Date of Patent: Jan. 30, 1990

[54] COLOR PHOTOGRAPHIC RECORDING MATERIAL CONTAINING A DIR-COUPLER

[75] Inventors: Heinrich Odenwälder, Leverkusen; Hans Ohlschläger, Gladbach; Friedrich-Wilhelm Kunitz, Leverkusen; Dirk Hübner, Cologne, all of Fed. Rep. of Germany

[73] Assignee: Agfa-Gevaert Aktiengesellschaft, Leverkusen, Fed. Rep. of Germany

[21] Appl. No.: 109,762

[22] Filed: Oct. 19, 1987

[30] Foreign Application Priority Data

Oct. 29, 1986 [DE] Fed. Rep. of Germany ..... 3636824

[51] Int. Cl.[4] ..... G03C 7/36

[52] U.S. Cl. ..... 430/544; 430/557

[58] Field of Search ..... 430/544, 557, 359, 362

[56] References Cited

U.S. PATENT DOCUMENTS

| | | | |
|---|---|---|---|
| 4,149,886 | 4/1979 | Tanaka et al. | 430/557 |
| 4,359,521 | 11/1982 | Fryberg et al. | 430/505 |
| 4,368,255 | 1/1983 | Borg | 430/351 |
| 4,518,682 | 5/1985 | Kobayashi et al. | 430/543 |
| 4,579,816 | 4/1986 | Öhlschläger et al. | 430/544 |

FOREIGN PATENT DOCUMENTS

| | | | |
|---|---|---|---|
| 222837 | 12/1984 | Japan | 430/557 |

*Primary Examiner*—Paul R. Michl
*Assistant Examiner*—Lee C. Wright
*Attorney, Agent, or Firm*—Connolly and Hutz

[57] ABSTRACT

Remarkably high inter-image and edge effects are obtained when DIR-Couplers corresponding to Formula I are added to multilayered color photographic recording materials, in particular to green sensitive or red sensitive layers. The sharpness and color reproduction may thereby be improved.

I $R^1$ and $R^2$ denote alkyl or an aromatic group,
$R^3$ denotes H, alkyl or acylamino,
$R^4$ denotes H or alkyl
$R^5$ denotes alkyl, alkinyl, aryl, acyloxy, carbamoyl or a cyclic imido group and
n has the value 0 or 1 and the total number of carbon atoms in $R^3$, $R^4$ and $R^5$ is greater than 3 but not greater than 11.

4 Claims, No Drawings

COLOR PHOTOGRAPHIC RECORDING MATERIAL CONTAINING A DIR-COUPLER

This invention relates to a colour photographic recording material having at least one light sensitive silver halide emulsion layer and containing a coupler which releases a development inhibitor in the process of colour development.

It is known to carry out chromogenic development in the presence of compounds from which diffusible substances capable of inhibiting the development of silver halide are released imagewise in the process of development. Such compounds are known as DIR-compounds (DIR=development inhibitor releasing). The DIR-compounds may be of the kind which react with the oxidation product of a colour developer to release an inhibitor group and form a dye (DIR-couplers) or they may release the inhibitor without at the same time forming a dye. The latter are referred to as DIR compounds in the strict sense of the word.

DIR-couplers have been disclosed, for example, in US-A- 3 148 062, US-A- 3 227 554, US-A- 3 615 506, and US-A- 3 617 291.

The released development inhibitors are generally heterocyclic mercapto compounds or derivatives of benzotriazole. DIR-compounds which mainly give rise to colourless compounds in the coupling reaction are described, for example, in US-A-3 632 345, DE-A-23 59 295 and DE-A-25 40 959. DIR compounds are capable of producing numerous photographic effects which influence the quality of the image. These include, for example, lowering of the gradation, the production of a finer colour grain, improvement in the sharpness of the image due to the so-called edge effect and improvement in the colour purity and colour brilliance by so-called interimage effects. Information on this subject may be found, for example, in the publication "Development Inhibitor Releasing (DIR) Couplers in Colour Photography" by C. R. Barr, J. R. Thirtle and P. W. Vittum, in Photographic Science and Engineering 13, 74 (1969).

DIR compounds which undergo coupling to yield colourless products have the advantage of a DIR couplers which produce coloured products of coupling in that they are universally applicable so that one and the same compound may be used in all the light sensitive layers of a colour photographic material, regardless of the colour to be produced. DIR-couplers can generally only be used in some of the light sensitive layers since the colour they produce may give rise to a colour side density which is not acceptable in the other layers. This advantage of DIR compounds is offset by the disadvantage that the DIR compounds are generally less reactive than DIR-couplers. Colour development has therefore in practice generally been restricted to the use of DIR-couplers and where necessary two or more different couplers have been used in a given recording material so that the various DIR-couplers could be associated with layers of the appropriate spectral sensitivity according to the colour produced from the coupler.

DIR-couplers derived from yellow couplers and containing a 3-alkylthio-1,2,4-triazolyl group as releaseable inhibitor group have been described in DE-A-28 42 063. When the DIR-couplers described in the said publication are used in a blue sensitive silver halide emulsion layer, they may considerably reduce the colour gradation in this layer but their effect on adjacent silver halide layers, in particular on adjacent green sensitive and/or red sensitive silver halide emulsion layers, is comparatively slight. Only slight inter-image effects can therefore be produced with these known DIR-couplers.

DIR-couplers also derived from yellow couplers but containing a releaseable 3-alkylthio-5-furyl-1,2,4-triazol group are described in DE-A-34 27 235. These couplers have a satisfactory remote effect in the sense of an inter-image effect when used in the blue sensitive layer.

They may also be used successfully in green sensitive layers but are then required at a higher concentration to produce a sufficient inter-image effect, and this in turn gives rise to a very high yellow side density which must be compensated. These compounds are only slightly effective in red sensitive layers.

A malonic amide derivative carrying in the coupling position a 1,2,4-triazol ring with particular substituents has been described in DE-A-26 55 871 but the DIR-coupler action of this compound is inconsiderable.

It is an object of the present invention to provide a colour photographic recording material containing DIR-couplers which are capable of producing comparatively high inter-image effects even when used in magenta or cyan layers.

The present invention relates to a colour photographic recording material having at least one light sensitive silver halide emulsion layer and a DIR-coupler associated with this layer, which coupler consists of a yellow coupler carrying a releaseable 1,2,4-triazolyl group in the coupling position, characterized in that the DIR-coupler corresponds to the following Formula I.

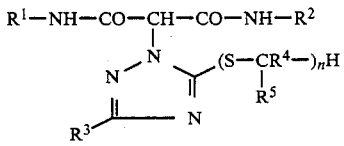

I wherein $R^1$ and $R^2$ (identical or different) denote alkyl or a carbocyclic or heterocyclic aromatic group, $R^3$ denotes H, alkyl or acylamino, $R^4$ denotes H or alkyl $R^5$ denotes alkyl, alkinyl, aryl, acyloxy, carbamoyl or a cyclic imido group, and n has the value 0 or 1, and the total number of carbon atoms in $R^3$, $R^4$ and $R^5$ is greater than 3 but not greater than 11.

An alkyl group denoted by $R^1$ or $R^2$ in Formula I may be straight chained or branched, substituted or unsubstituted and contains 1 to 20 carbon atoms; methyl, ethyl, butyl, hexyl and dodecyl are examples.

An aromatic group denoted by $R^1$ or $R^2$ in Formula I may ben an aryl group, e.g. phenyl, or a heterocyclic group, e.g. thienyl or pyridyl.

The above mentioned groups may be substituted, e.g. by alkyl, alkoxy, halogen, alkoxycarbonyl, carbamoyl, sulphamoyl or acylamino in which the acyl group may be derived from aliphatic or aromatic carboxylic acids or sulphonic acids or from carbamic acids or carbonic acid monoesters. It is preferred if, in this formula, either one or both of the groups $R^1$ and $R^2$ denote phenyl; if both are phenyl groups, then these may be differently substituted.

An alkyl group denoted by $R^3$, $R^4$ or $R^5$ contains 1 to 7 carbon atoms. Methyl, ethyl, propyl, isopropyl, butyl, s-butyl, pentyl, and hexyl are examples. The alkyl groups may be substituted, e.g. by hydroxyl, alkoxy or alkyl thio.

An alkinyl group denoted by $R^5$ is preferably ethinyl.

A cyclic imido group denoted by $R^5$ may be, for example, a succinimido group, a maleic imido group, a phthalimido group, a hexahydrophthalimido group or a group corresponding to the Formula.

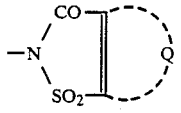

wherein Q denotes the group required for completing a carbocyclic or heterocyclic, optionally substituted ring.

The DIR-couplers used are preferably compounds corresponding to the following Formula II

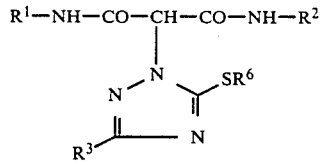

II wherein $R^1$, $R^2$ and $R^3$ have the meanings already indicated and $R^6$ denotes an optionally substituted alkyl group or a 2-propinyl group.

According to Formula I as shown here, the 1,2,4-triazole ring has one of its two adjacent ring nitrogen atoms attached to the coupling position of the coupler group. Since, however, it has to this day not been fully clarified whether this corresponds to the true structure, formula I should be understood to apply also to the corresponding isomers in which the 1,2,4-triazol ring may be attached to the coupling position by any other ring nitrogen atom.

Examples of suitable DIR-couplers according to the present invention are shown below (Formula I).

| DIR-coupler (DIR-) | $R^1=R^2$ | $R^3$ | $R^4$ | $R^5$ | n |
|---|---|---|---|---|---|
| 1 | 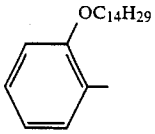 | H | H | $-C_5H_{11}$ | 1 |
| 2 | 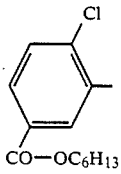 | H | H | $-C_5H_{11}$ | 1 |
| 3 | 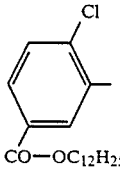 | $-CH_3$ | H | $-C_4H_9$ | 1 |
| 4 | 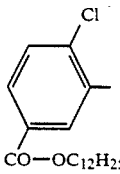 | $-CH_3$ | H | $-C_5H_{11}$ | 1 |
| 5 | 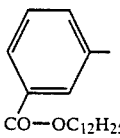 | H | H | $-C_5H_{11}$ | 1 |

-continued
| DIR-coupler (DIR-) | $R^1=R^2$ | $R^3$ | $R^4$ | $R^5$ | n |
|---|---|---|---|---|---|
| 6 | 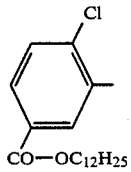 | H | H | $-C_5H_{11}$ | 1 |
| 7 | 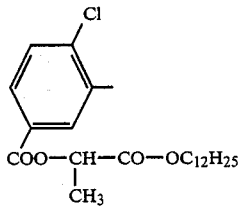 | H | H | $-C_5H_{11}$ | 1 |
| 8 | 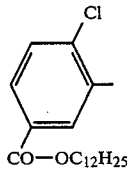 | H | H | $-O-CO-C_4H_9-t$ | 1 |
| 9 | 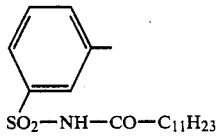 | H | H | 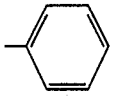 | 1 |
| 10 | 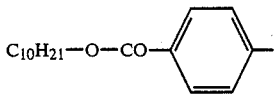 | $-C_2H_5$ | H | $-C\equiv CH$ | 1 |
| 11 | 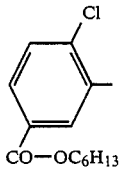 | H | H | 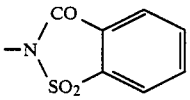 | 1 |
| 12 | 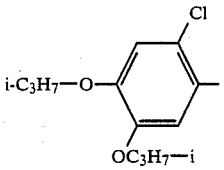 | H | H | $-C_6H_{13}$ | 1 |
| 13 | 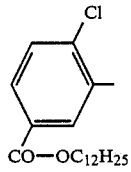 | H | H | $-C_6H_{13}$ | 1 |
| 14 | 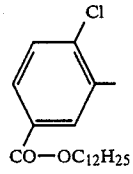 | H | $-CH_3$ | $-C_5H_{11}$ | 1 |

-continued

| DIR-coupler (DIR-) | $R^1=R^2$ | $R^3$ | $R^4$ | $R^5$ | n |
|---|---|---|---|---|---|
| 15 | 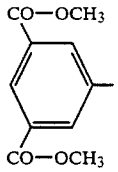 | H | H | $-C_5H_{11}$ | 1 |
| 16 | 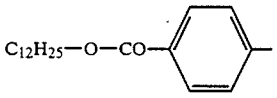 | H | H | $-C_5H_{11}$ | 1 |
| 17 | 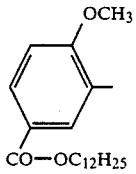 | H | H | $-C_5H_{11}$ | 1 |
| 18 | 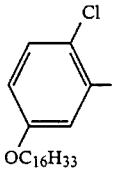 | $-CH_3$ | $-C_2H_5$ | $-C_2H_5$ | 1 |
| 19 | 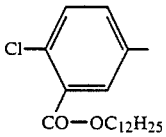 | $-NH-CO-CH_3$ | H | $-C_3H_7$ | 1 |
| 20 | 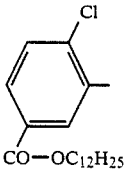 | $-CH_2-S-CH_3$ | H | $-C_4H_9$ | 1 |
| 21 | 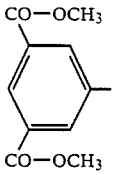 | $-C_7H_{15}$ | — | — | 0 |
| 22 | 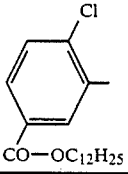 | H | H | 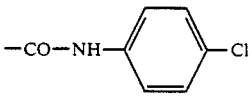 | 1 |

The DIR-couplers according to the invention corresponding to Formula I are readily obtained by the condensation of known α-halogen-malonic acid amides corresponding to Formula III.

$$R^1-NH-CO-\underset{\underset{Hal}{|}}{CH}-CO-NH-R^2 \qquad \text{III}$$

wherein $R^1$ and $R^2$ have the meanings already indicated and

Hal denotes a halogen atom, in particular chlorine or bromine, with triazoles corresponding to Formula IV

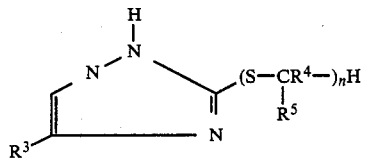

IV wherein $R^3$, $R^4$ and $R^5$ have the meanings indicated.

The reaction is advantageously carried out in an organic solvent such as dimethyl formamide, acetone nitrile or acetone in the presence of a base such as triethylamine or caustic alkali.

The triazoles of Formula IV may in turn be obtained, for example, by the reaction of the corresponding 3-mercapto-1,2,4-triazoles with suitable alkyl halides.

Since the triazoles of Formula IV may occur in various tautomeric forms and various resonating structures may therefore be assigned to the azeniate ion, any of the ring nitrogen atoms present could conceivably become attached to the carbon atom in the coupling position the process of condensation, and this would explain the occurrence of corresponding isomers. This isomerism, however, has no influence on the use properties of the DIR-couplers according to the invention and it is therefore unnecessary at this point to discuss the structure of the possible isomers.

The preparation of DIR-couplers according to the invention is described below with reference to DIR-coupler 6 used as example.

DIR-Coupler 6

16.6 g of α-bromomalonic acid-bis-(2-chloro-5-dodecyloxycarbonyl anilide) and 3.7 g of 3-hexylthio-1,2,4-triazole were suspended in 150 ml of acetonitrile and 4.6 g of tetramethyl guanidine were added. The reaction mixture was stirred at room temperature for four hours and then poured into water to which a small quantity of acetic acid had been added. The pasty precipitate obtained was dissolved in methylene chloride. The solution obtained was dehydrated over $Na_2SO_4$, filtered and concentrated by evaporation.

The crude product (13.9 g) was separated by means of a fluidizing mixture of toluene/ethylacetate (20:1) in a column filled with silica gel, 7.5 g of compound 6 melting at 72°-74° C. were obtained from the appropriate fractions after removal of the solvent by evaporation and crystallization from methanol.

The compounds of the present invention are suitable for use as DIR-couplers in colour photographic recording materials, in particular in multilayered materials. Most of them are yellow couplers, and as such they are preferably used in or in association with a light sensitive silver halide emulsion layer which is predominantly sensitive to the blue spectral region of visible light. The special advantage of the DIR-couplers according to this invention, namely their comparatively slight inhibition of development in the layer with which they are associated combined with their comparatively powerful inhibition of development in adjacent layers with which they are not associated, is particularly important in multilayered colour photographic recording materials which contain light sensitive silver halide emulsion layers predominantly sensitive to the green or red spectral region of visible light in addition to a predominantly blue sensitive silver halide emulsion layer.

Owing to their powerful effect, the DIR-couplers according to the invention may be used in comparatively small quantities to produce the desired effects, in particular the inter-image effects. This enables the DIR-couplers according to the invention to be used not only in the blue sensitive layers in which the yellow dye is produced but also in other layers without giving rise to excessive side densities. The DIR-couplers according to the invention may therefore also be used to advantage in magenta layers and in cyan layers.

For the preparation of the light sensitive colour photographic recording material, the diffusion resistant DIR-couplers according to the present invention may be incorporated in known manner in the casting solution for the silver halide emulsion layers or other colloid layers, optionally together with other couplers. Oil soluble or hydrophobic couplers, for examples, may advantageously be added to a hydrophilic colloid solution from a solution in a suitable coupler solvent (oil former) optionally in the presence of a wetting agent or dispersing agent. The hydrophilic casting solution may, of course, contain other conventional additives in addition to the binder. The solution of coupler need not be dispersed directly in the casting solution for the silver halide emulsion layer or other water permeable layer but may advantageously first be dispersed in an aqueous, light insensitive solution of a hydrophilic colloid, and the resulting mixture may then be added to the casting solution for the light sensitive silver halide emulsion layer or other water permeable layer, optionally after removal of the low boiling organic solvent used.

The light sensitive silver halide emulsions used may be the emulsions of silver chloride, silver bromide or mixtures thereof, optionally with a small silver iodide content of up to 10 mol %, in one of the conventional hydrophilic binders. The binder used in the photographic layers is preferably gelatine although this may be partly or completely replaced by other natural or synthetic binders.

The emulsions may be chemically and spectrally sensitized in the usual manner and both emulsion layers and other, light insensitive layers may be hardened with known hardeners in the usual manner.

Colour photographic recording materials normally contain at least one silver halide emulsion layer for the recording of light from each of the three spectral regions, red, green and blue. The light sensitive layers are spectrally sensitized with suitable sensitizing dyes are this purpose in known manner. Blue sensitive silver halide emulsion layers need not necessarily contain a spectral sensitizer since the intrinsic sensitivity of the silver halide is in many cases sufficient for the recording of blue light.

Each of the above mentioned light sensitive layers may consist of a single layer or it may be composed in known manner of two or more silver halide emulsion partial layers, e.g. as in the so-called double layer arrangement (DE-C-1 121 470). Red sensitive silver halide emulsion layers are normally arranged closer to the layer support than green sensitive silver halide emulsion layers, which in turn are arranged closer to the support that blue sensitive layers, and the green sensitive and blue sensitive layers are generally separated by a light insensitive yellow filter layer; but other arrangements could also be used. A light insensitive inter-layer which may contain means for preventing accidental diffusion of developer oxidation products is generally placed between layers which differ in their spectral sensitivity. If a photographic material contains several silver halide emulsion layers of the same spectral sensitivity, these layers may be arranged adjacent to one another or they may be separated by a light sensitive layer having a different spectral sensitivity (DE-A-1 958 709, DE-A-2 530 645 and DE-A-2 622 922).

In colour photographic recording materials for the production of multicolour images, colour producing compounds for producing the different partial colour images in cyan, magenta and yellow, in the present case in particular colour couplers, are normally arranged in spatial and spectral association with the various silver halide emulsion layers of the different spectral sensitivities.

By "spatial association" is meant that the colour coupler is situated in such a spatial relationship to the silver halide emulsion layer that the coupler and the emulsion layer are capable of interacting to give rise to an imagewise correspondence between the silver image formed on development and the colour image produced from the colour coupler. This is generally achieved by producing a colour coupler in the silver halide emulsion layer itself or in an adjacent layer of binder which may be insensitive to light.

By "spectral association" is meant that the spectral sensitivity of each of the light sensitive silver halide emulsion layers and the colour of the partial colour image produced from the spatially associated colour coupler are in a certain relationship to one another so that each of the spectral sensitivities (red, green, blue) is associated with a different colour of the partial colour image (e.g. cyan, magenta, yellow).

Each of the silver halide emulsion layers which differ from one another in their spectral sensitivity may be associated with one or more than one colour coupler. Where there are several silver halide emulsion layers having the same spectral sensitivity, each of these layers may contain a colour coupler and these colour couplers need not be identical, provided only that on colour development they give rise to at least approximately the same colour, normally a colour which is complementary to the colour of the light to which the associated silver halide emulsion layers are predominantly sensitive.

In preferred embodiments, therefore, red sensitive silver halide emulsion layers are associated with at least one non-diffusible colour coupler to produce the cyan partial colour image, generally a coupler of the phenol or α-naphthol series. Suitable cyan couplers are described, for example, in EP-A-0 028 099, EP-A-0 067 689, EP-A-0 175 573 and EP-A-0 184 057. Green sensitive silver halide emulsion layers have at least one non-diffusible colour coupler associated with them to produce the magenta partial colour image, this coupler being usually a compound of the 5-pyrazolone, the indazlone or the pyrazoloazole series. Blue sensitive silver halide emulsion layers have at least one non-diffusible colour coupler associated with them to produce the yellow partial colour image, generally a colour coupler containing an open chain ketomethylene group. Colour couplers of this kind are known in large numbers and have been described in numerous patent specifications and other publications, for example in the publication entitled "Farbkuppler" by W. PELZ in "Mitteilungen aus den Forschungslaboratorien der Agfa, Leverkusen/Munchen", Volume III, Page 111 (1961) and the publication by K. VENKATARAMAN in "The Chemistry of Synthetic Dyes", Volume 4, 341 to 387, Academic Press (1971).

The colour couplers may be either conventional 4-equivalent couplers or they may be 2-equivalent couplers which require a smaller quantity of silver halide to produce the colour. 2-equivalent couplers are derived, as is known, from 4-equivalent couplers in that they carry in the coupling position a substituent which is released in the coupling reaction. The 2-equivalent couplers include both those which are virtually colourless and those which have an intense colour of their own which disappears in the process of colour coupling to be replaced by the colour of the image dye produced. The latter couplers may be used in light sensitive silver halide emulsion layers to serve as masking couplers to compensate for unwanted side densities in the image dyes. Also to be included among the 2-equivalent couplers are the known white couplers which do not give rise to a dye in their reaction with colour developer oxidation products, and the known DIR-couplers which carry in their coupling position a group which is released as diffusible development inhibitor when the coupler reacts with colour developer oxidation products. Other photographically active compounds, e.g. development accelerators or foggants, may also be released from such couplers in the process of development.

According to the invention, the colour photographic recording material in addition contains at least one 2-equivalent coupler corresponding to Formula I, which coupler may be contained not only in the yellow layer but also in the magenta layer and/or in the cyan layer or in a light insensitive layer adjacent to one of the aforesaid layers.

In addition to the constituents already mentioned, the colour photographic recording material according to the present invention may contain other additives, e.g. anti-oxidants, dye stabilizers and agents for influencing the mechanical and electrostatic properties. It is also advantageous to use UV absorbent compounds in one or more of the layers of the recording material, preferably in one of the upper layers, for the purpose of preventing or reducing the deleterious effect of UV light on the colour images produced with the colour photographic recording material according to the invention. Suitable UV absorbents are described, for example, in US-A-3 253 921, DE-C-2 036 719 and EP-A-0 057 160.

The usual layer supports may be used for the materials according to the invention; see Research Disclosure No. 17 643, Section XVII.

The usual hydrophilic film forming agents are suitable for use as protective colloids or binders for the layers of the recording material, e.g. proteins, in particular gelatine.

Casting auxiliaries and softeners may also be used; see the compounds mentioned in Research Disclosure No. 17 643 Sections IX, XI and XII.

The layers of the photographic material may be hardened in the usual manner, for example with hardeners of the epoxide type or of the heterocyclic ethylene imine or acryloyl type. The layers may also be hardened by the process described in DE-A-22 18 009 to produce colour photographic materials suitable for high temperature processing. Furthermore, the photographic layers may be hardened with hardeners of the diazine, triazine, or 1,2-dihydroquinoline series or with hardeners of the vinyl sulphone series. Other suitable hardeners have been disclosed in DE-A-24 39 551, DE-A-22 25 230, and DE-A-23 17 672 and in the above mentioned Research Disclosure 17 643, Section XI.

Other suitable additives are mentioned in Research Disclosure 17 643 and in "Product Licensing Index" of Dec., 1971, Pages 107–110.

The colour photographic recording material according to the invention is developed with a colour developer compound to produce colour photographic images. The colour developer compounds used may be any developer compounds which are capable, in the form of their oxidation product, to react with colour couplers to form azomethine dyes. Suitable colour developer compounds include aromatic compounds of the p-phenylene diamine series containing at least one primary amino group, e.g. N,N-dialkyl-p-phenylene diamines such as N,N-diethyl-p-phenylene diamine, 1-(N-ethyl-N-methyl-sulphonamido ethyl)-3-methyl-p-phenylene diamine, 1-(N-ethyl-N-hydroxyethyl)-3-methyl-p-phenylene diamine and 1-(N-ethyl-N-methoxyethyl)-3-methyl-p-phenylene diamine.

Other suitable colour developers are described, for example in J. Amer. Chem. Soc. 73, 3100 (1951) and by G. Haist, in Modern Photographic Processing, 1979, John Wiley and Sons, N.Y., Pages 545 etc.

After colour development, the material is bleached and fixed in the usual manner. Bleaching and fixing may be carried out separately or together. The usual bleaching compounds may be used, e.g. $Fe^{3+}$ salts and $Fe^{3+}$ complex salts such as ferricyanides, dichromates, water soluble cobalt complexes, etc. Iron-III complexes of amino polycarboxylic acids are particularly preferred, e.g. the complexes of ethylene diamino tetracetic acid, of N-hydroxy ethyl-ethylene-diamino-triacetic acid, of alkyl imino dicarboxylic acides and of the corresponding phosphonic acids. Persulphates are also suitable bleaching agents.

EXAMPLE 1

A colour photographic recording material for colour negative development was prepared by applying the following layers in the sequence given to a transparent layer support of cellulose triacetate. The quantities given are based on 1 $m^2$. The quantities of silver halide applied are given in terms of the corresponding quantities of $AgNO_3$. All silver halide emulsions were stabilized with 0.5 g of 4-hydroxy-6-methyl-1,3,3*a*, 7-tetraazaindene per 100 g of $AgNO_3$.

| | |
|---|---|
| Layer 1 | (Antihalation layer)<br>Black colloidal silversol containing<br>0.4 g of Ag and 3 g of gelatine. |
| Layer 2 | (1st red sensitized layer)<br>Red sensitized silver iodobromide emulsion<br>(7 mol % iodide; average particle diameter<br>0.6 μm) obtained from 2.7 g of $AgNO_3$ with<br>0.51 g of coupler C-1,<br>0.078 g of masking coupler MC-1,<br>$2.1 \times 10^{-5}$ mol of DIR-coupler (see Table 1),<br>with the exception of DIR-coupler D-2, which<br>is used in a quantity of $1.15 \times 10^{-5}$ mol,<br>and<br>1.5 g of gelatine. |
| Layer 3 | (2nd red sensitized layer)<br>Red sensitized silver iodobromide emulsion<br>(10 mol % iodide;<br>average grain diameter 1.5 μm) obtained from<br>3.8 g of $AgNO_3$ with<br>0.137 g of coupler C-1 and<br>2.7 g of gelatine. |

-continued

| | |
|---|---|
| Layer 4 | (Interlayer)<br>0.15 g of white coupler W-1 and<br>0.8 g of gelatine. |
| Layer 5 | (1st green sensitized layer)<br>Green sensitized silver iodobromide<br>emulsion (7 mol % iodide;<br>average grain diameter 0.6 μm)<br>obtained from 2.0 g of $AgNO_3$ with<br>0.403 g of coupler M-1,<br>0.175 g of masking coupler MC-2,<br>$1.3 \times 10^{-5}$ mol of DIR-coupler D-1<br>and<br>1.4 g of gelatine. |
| Layer 6 | (2nd green sensitized layer)<br>Green sensitized silver iodobromide<br>emulsion (4 mol % iodide;<br>average grain diameter 1.4 μm)<br>obtained from 2.5 g of $AgNO_3$ with<br>0.2 g of coupler M-1 and<br>1.6 g of gelatine. |
| Layer 7 | (Interlayer)<br>0.1 g of white coupler W-1 and<br>0.34 g of gelatine. |
| Layer 8 | (yellow filter layer)<br>Yellow colloidal silversol containing 71 mg<br>of Ag, 0.1 g of white coupler W-1 and 0.5 g<br>of gelatine. |
| Layer 9 | (1st blue sensitive layer)<br>Silver iodobromide emulsion<br>(4.5 mol % iodide;<br>average grain diameter 0.5 μm) obtained from<br>0.5 g of $AgNO_3$ with 0.8 g of coupler Y-1,<br>$4.8 \times 10^{-5}$ mol of DIR-coupler D-1<br>and<br>1.4 g of gelatine. |
| Layer 10 | (2nd blue sensitive layer)<br>Silver iodobromide emulsion<br>(10 mol % iodide;<br>average grain diameter 1.5 μm)<br>obtained from 0.8 g of $AgNO_3$ with<br>2.81 g of coupler Y-1 and<br>1.4 g of gelatine. |
| Layer 11 | (Protective layer)<br>0.7 g of gelatine |
| Layer 12 | (Hardening layer)<br>0.24 g of gelatine and 0.7 g of carbamoyl-<br>pyridinium salt (CAS Reg. No. 65411-60-1) |

Compounds C-1, M-1, MC-1, MC-2, Y-1 and the DIR-couplers were used in the form of emulsions containing 1 part of gelatine, two parts of tricresylphosphate in the case of compounds M-1 and MC-2 and di-n-butylphthalate in all other cases, and 0.1 part of the sodium salt of triisopropyl-naphthalene sulphonic acid as wetting agent, the parts given being based on 1 part of the coupler compound used.

Various versions (materials 1 to 7) of the recording material having the structure described above were prepared, the versions differing only in the DIR-coupler used in layer 2. Development was carried out after exposure to reflected light through a grey wedge as described in "The Journal of Photography", 1974, Pages 597 and 598.

The results obtained after processing are shown in Table 1. The interimage effects IIE are calculated as follows:

$$IIE_{bg} = \frac{\gamma_{red} - \gamma_w}{\gamma_w} \; ; \; IIE_{pp} = \frac{\gamma_{green} - \gamma_w}{\gamma_w}$$

where

γred is the gradation obtained after selective exposure to red light

γgreen is the gradation obtained after selective exposure to green light and

γw is the gradation obtained after exposure to white light

The edge effect KE entered in Table 1 is the difference between the micro density and the macro density at macro density = 1, as described in James, The Theory of the Photographic Process, 5th Edition, Macmillan Publishing Co. Inc. 1977, Page 611. Where $KE_{bg}$ = KE in the red sensitized layer and $KE_{pp}$ = KE in the green sensitized layer

TABLE 1

| Material | DIR-Coupler | $IIE_{bg}$ | $IIE_{pp}$ | $KE_{bg}$ | $KE_{pp}$ |
|---|---|---|---|---|---|
| 1 | D-2 | 30 | 27 | 0.35 | 0.27 |
| 2 | D-3 | 27 | 27 | 0.34 | 0.27 |
| 3 | 2 | 28 | 40 | 0.34 | 0.29 |
| 4 | 3 | 30 | 34 | 0.33 | 0.28 |
| 5 | 4 | 30 | 27 | 0.35 | 0.26 |
| 6 | 6 | 37 | 34 | 0.38 | 0.30 |
| 7 | 7 | 37 | 36 | 0.34 | 0.28 |

Coupler C-1

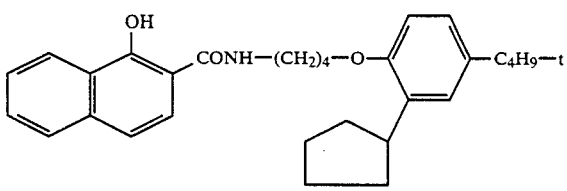

White Coupler W-1

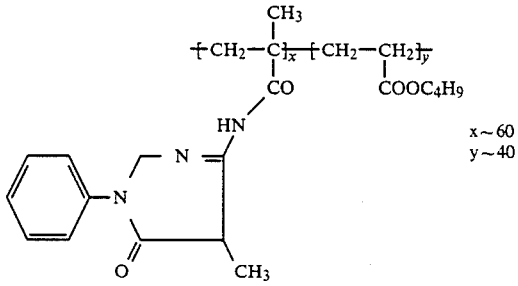

Coupler M-1

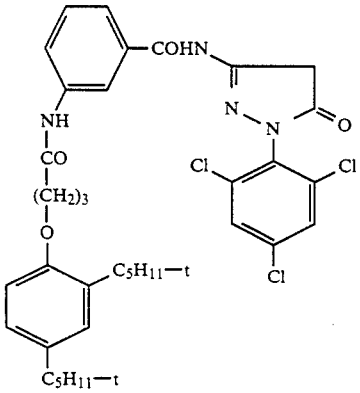

Masking Coupler MC-1

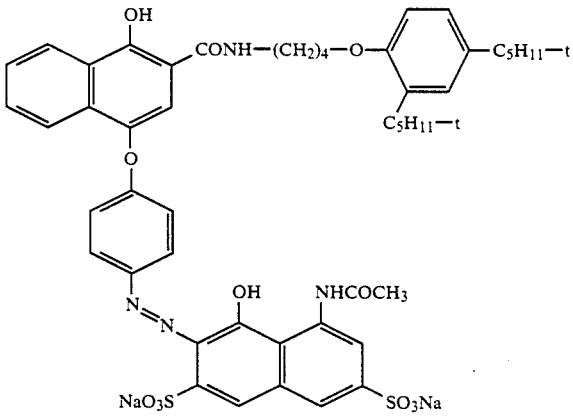

TABLE 1-continued

Masking Coupler MC-2

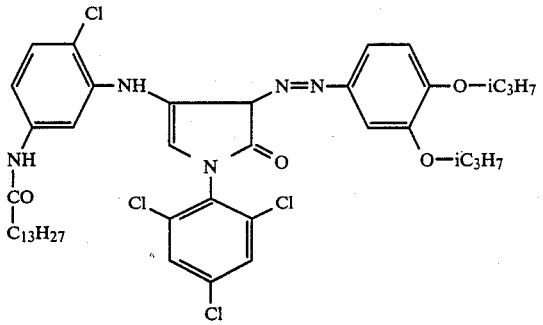

Coupler Y-1

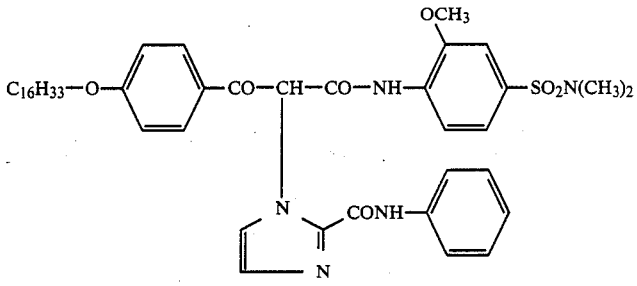

D-1

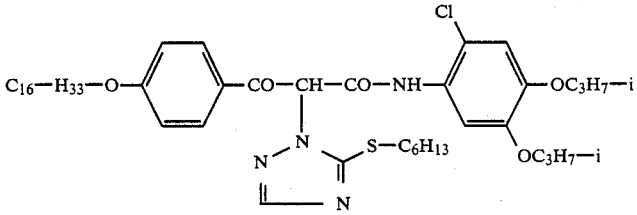

(D-1 has been described as compound No. 3 in German Patent Application P 36 26 219.6)

D-2

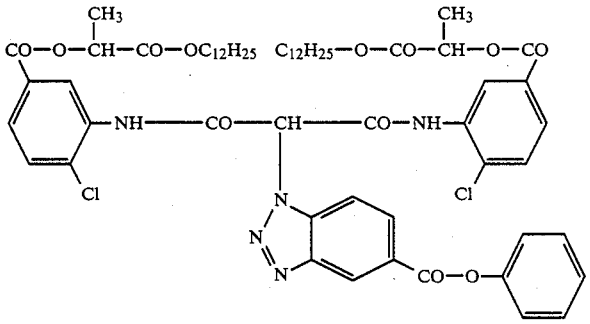

(D-2 has been described as compound No. 51 in DE-A-32 09 486)

D-3

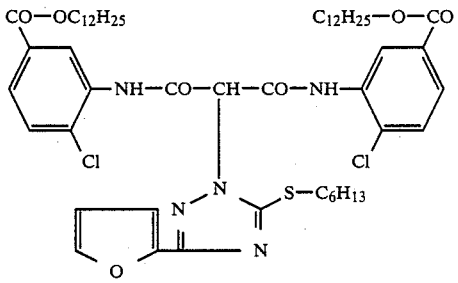

(According to DE-A-34 27 235, see Compound No. 11).

We claim:

1. Colour photographic recording material containing at least one light sensitive silver halide emulsion layer and a DIR-coupler which is associated with this layer and contains attached to the coupling position, a releasable, 1,2,4-triazolyl group, characterized in that the DIR-coupler corresponds to the following formula:

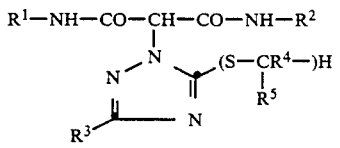

wherein $R^1$, $R^2$ (identical or different) denote alkyl or a carboxylic or heterocyclic aromatic group, $R^3$denotes H, or acylamino, $R^4$ denotes H or alkyl $R^5$ denotes alkyl, alkinyl, aryl, acyloxy, carbamoyl or a cyclic imido group, and the total number of carbon atoms in $R^3$, $R^4$ and $R^5$ is greater than 3, but not greater than 11.

2. Recording material according to claim 1, characterized in that the DIR-Coupler is contained in a predominantly blue sensitive silver halide emulsion layer and in that the recording material contains at least one other silver halide emulsion layer which is predominantly green sensitive or predominantly red sensitive.

3. Colour photographic recording material according to claim 1, characterized in that the DIR-Coupler is contained in a predominantly red sensitive silver halide emulsion layer.

4. Colour photographic recording material containing at least one predominantly blue sensitive silver halide emulsion layer unit with which at least one yellow coupler is associated, a predominantly green sensitive silver halide emulsion layer unit with which at least one magenta coupler is associated and a predominantly red sensitive silver halide emulsion layer unit with which at least one cyan coupler is associated, characterized in that at least one partial layer of the predominantly green sensitive silver halide emulsion layer unit or of the predominantly red sensitive silver halide emulsion layer unit contains a compound corresponding to the following Formula:

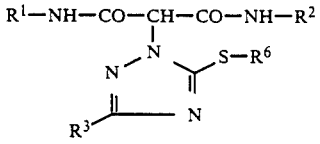

wherein $R^1$, $R^2$ denote alkyl or aryl, $R^3$ denotes H, or acylamino and $R^6$ denotes alkyl or propinyl.

* * * * *